US005701931A

United States Patent [19]

Phillips et al.

[11] Patent Number: 5,701,931

[45] Date of Patent: Dec. 30, 1997

[54] WATER RELIEF VALVE FOR A DRAINAGE SYSTEM

[76] Inventors: Trevor J. Phillips; James E. Petrie, both of 851 N. Harvard, Lindsay, Calif. 93247

[21] Appl. No.: 550,245

[22] Filed: Oct. 30, 1995

Related U.S. Application Data

[63] Continuation-in-part of Ser. No. 16,534, Dec. 17, 1993, Pat. No. Des. 363,769.

[51] Int. Cl.[6] ..... F16K 15/02

[52] U.S. Cl. ..... 137/533.29; 137/356; 137/533.17; 239/201

[58] Field of Search ..... 137/356, 533.17, 137/533.21, 533.29; 239/201, 453, 454

[56] References Cited

U.S. PATENT DOCUMENTS

| | | | |
|---|---|---|---|
| 1,151,089 | 8/1915 | Dietsch | 239/454 |
| 1,845,618 | 2/1932 | Miller | 239/454 |
| 2,751,250 | 6/1956 | Block | 137/377 X |
| 3,210,056 | 10/1965 | Van't Sant | 137/533.17 X |
| 3,396,409 | 8/1968 | Melrose | 137/533.17 X |
| 3,513,485 | 5/1970 | Davila | 137/533.17 X |
| 4,161,186 | 7/1979 | Sitarz | 137/356 X |
| 4,382,901 | 5/1983 | Thomas | 137/533.17 X |
| 5,209,257 | 5/1993 | Baker | 137/357 X |

*Primary Examiner*—Gerald A. Michalsky
*Attorney, Agent, or Firm*—Richard D. Slehofer

[57] ABSTRACT

A water relief valve for a drainage system includes a hollow cylinder body and a poppet valve which is inserted into the top of the cylinder body. The pair is connected to the top of a buried pipe section and is flush with the ground after installation. The pipe section connects the downspout of a gutter system to the valve which is positioned away from the building. During rainfall the runoff water passes through the underground pipe until it reaches the valve and forces the valve open and the water discharges around the valve and away from the structure. In this way the runoff water can be dispersed to the grass area away from the house. When not in use, the valve lies flush with the grass and is unobtrusive. The water relief valve also has applications for drainage of large playing fields, farm acreage, and paved areas such as parking lots.

7 Claims, 3 Drawing Sheets

WATER RELIEF VALVE FOR A DRAINAGE SYSTEM

CROSS REFERENCE TO RELATED APPLICATIONS

This is a continuation-in-part patent application of Ser. No. 29/016,534 filed on Dec. 17, 1993, now U.S. Pat. No. Des. 363,769.

This invention relates to a water relief valve for a drainage system. Sitarz, U.S. Pat. No. 4,161,186 discloses a similar device for diverting rainwater from a gutter system secured to the edge of a roof on a house. The downspout drains the water from the gutter system. The downspout is connected to an underground horizontal pipe to carry water runoff away from the building. The relief valve allows the water to drain out of the pipe, and yet prevent leaves and debris from clogging the

SUMMARY AND OPERATION OF THE INVENTION

The water relief valve for a drainage system has a stationary cylinder component and a separate poppet valve component. The lower portion of the stationary component is a cylinder-shaped wall. This fits into an underground pipe connection to allow water to exit the present invention when water is in the underground pipes. Pipes are laid in open fields or parks to improve drainage of the fields or parks after heavy rains or to improve drainage of the fields. Gutter systems which trap the water runoff from roofs also require that the water be diverted to the grass area rather than near the house. The underground plastic pipes are placed in shallow troughs with plastic pipe connections placed where the water is to be released to the surface. The pipes are placed in the trough so that the top of the present invention is flush with the surface of the grass, or soil, or pavement when it is connected to the pipe connection. The troughs containing the pipes are then covered with soil, and only the top of the present invention remains visible. The water flows to the present invention through the underground pipes and the force of the water causes the poppet valve to rise to allow the water to escape and drain off around the invention. The poppet valve has three legs with hooks to prevent the valve from separating from the cylinder body while the water to flowing. When the water is not flowing, the poppet valve rests in a seat in the cylinder component. When the valve is seated in the cylinder component, the top of the invention has a shallow dome-shaped appearance. The seated valve prevents debris or even small animals from entering the drainage system. It prevents clogging of the drainage system with leaves, lawn clippings, twigs and the like.

DETAILED DESCRIPTION OF THE PREFERRED EMBODIMENT

Figure 1:
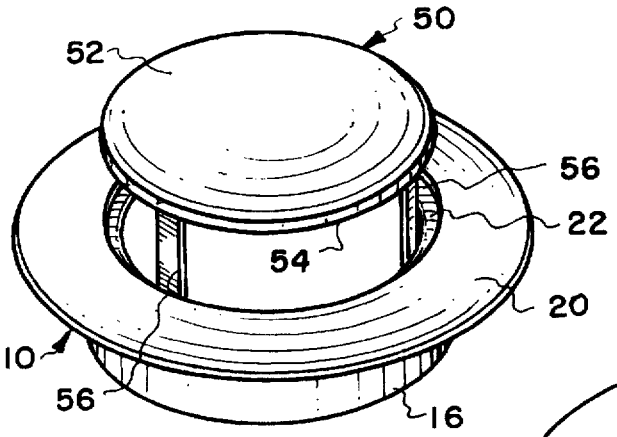
FIG. 1 is a perspective view of the water relief valve for a drainage system in the open position.
Figure 2:
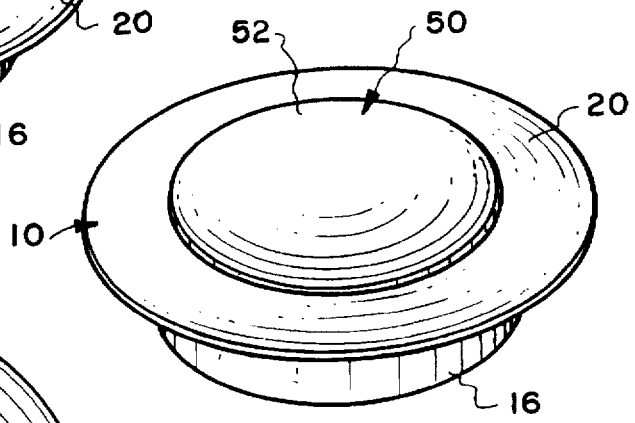
FIG. 2 is a perspective view of the present invention in the closed position.
Figure 3:
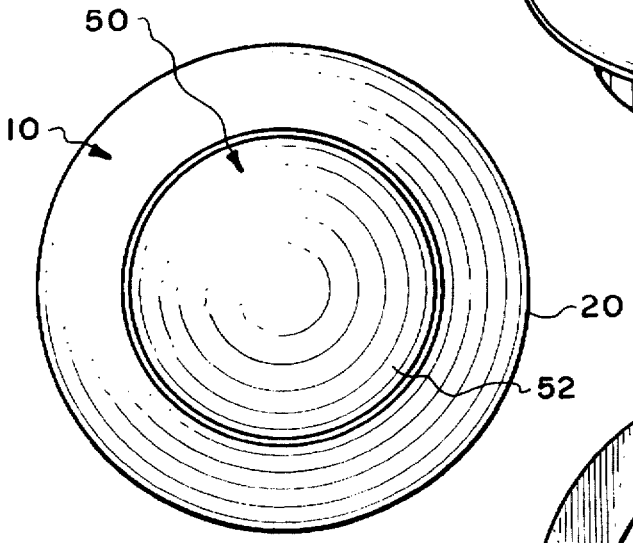
FIG. 3 is a top plan view of the present invention.
Figure 4:
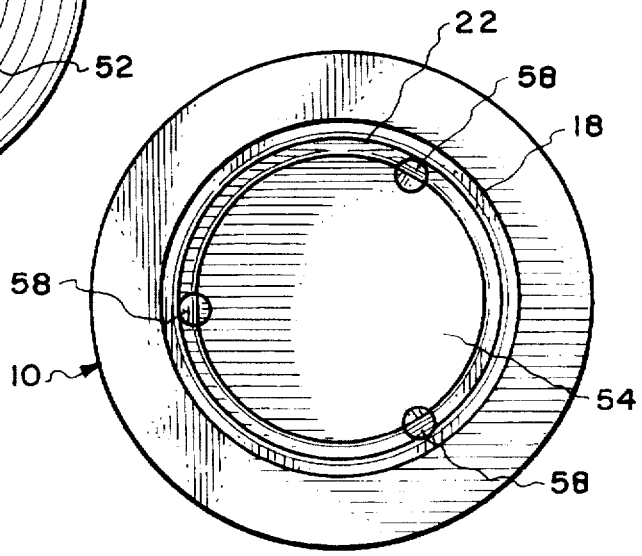
FIG. 4 is a bottom plan view of the present invention.
Figure 5:
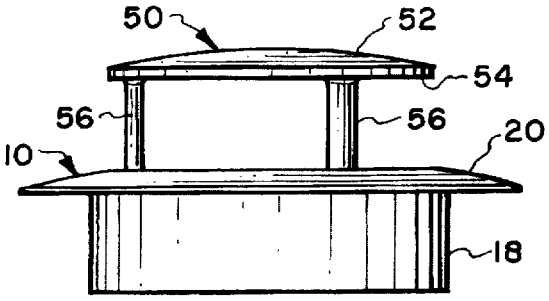
FIG. 5 is a side elevational plan of the present invention in the open position. The opposite side is a mirror image of that shown in this drawing.
Figure 6:
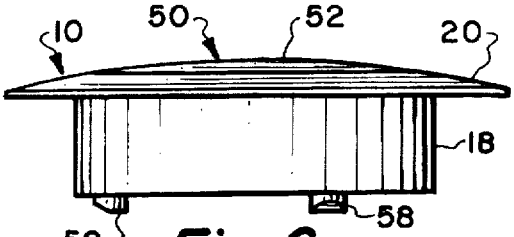
FIG. 6 is a side elevational view of the present invention in the closed position. The opposite side is a mirror image of that shown in this drawing.
Figure 7:
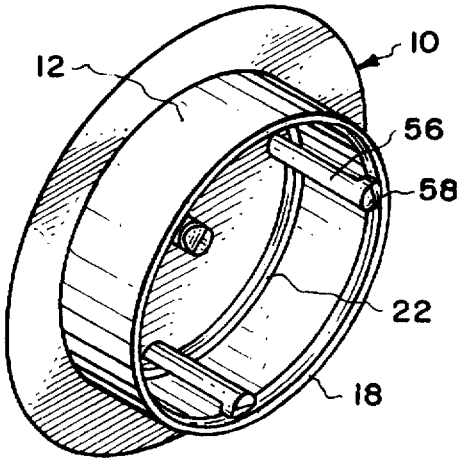
FIG. 7 is a bottom perspective view of the present invention the closed position.
Figure 8:
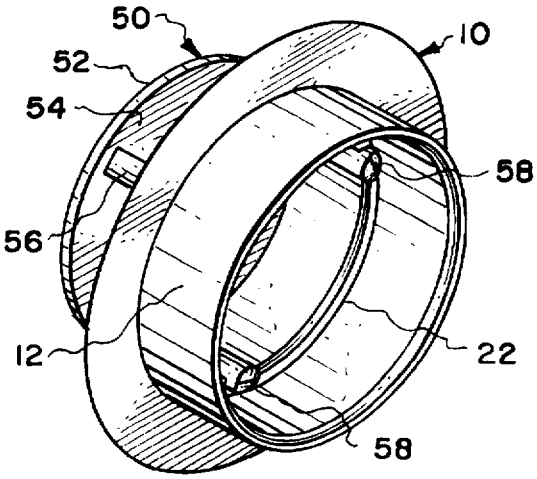
FIG. 8 is a bottom perspective view of the present invention in the open position.
Figure 9:
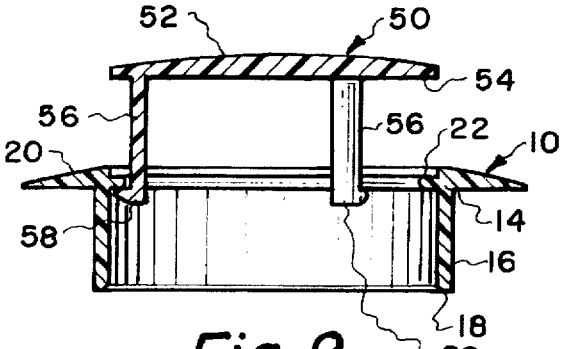
FIG. 9 is a vertical medial sectional view of the present invention as shown in FIG. 5.
Figure 11:
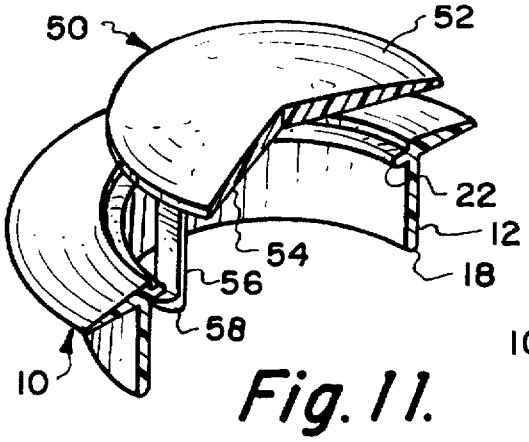
FIG. 11 is a perspective sectional view of the present invention shown in the open position.
Figure 12:
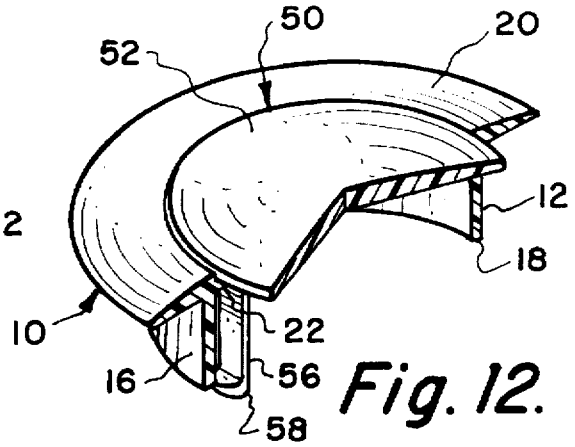
FIG. 12 is a perspective sectional view of the present invention shown in the closed position.
Figure 13:
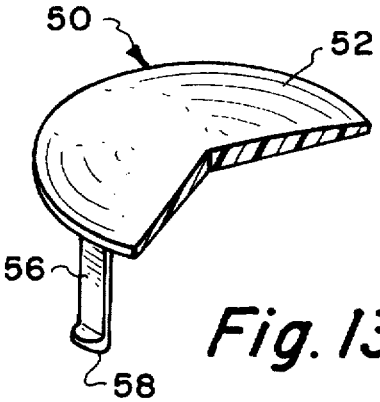
FIG. 13 is a perspective sectional view showing the valve component of the present invention.
Figure 14:
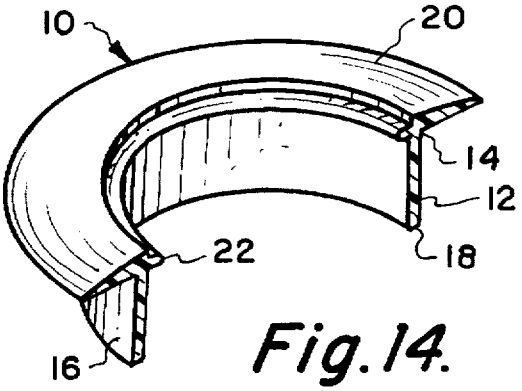
FIG. 14 is a perspective sectional view of the stationary component of the present invention.

The present invention will now be discussed in greater detail. FIG. 1 illustrates the cylinder body component 10 and the poppet valve component 50 in the open position where water can flow out of the drainage system. FIG. 11 is similar to FIG. 1 and is a cutaway view also showing the present invention in the open position. FIG. 2 shows the poppet valve in the closed position. FIG. 12 is similar to FIG. 2 and is a cutaway view showing the present invention in the closed position. The poppet valve has a disc-shaped top 52 and a bottom 54. The top 52 should have a slight dome-shaped surface. The bottom 54 can be flat, concave or convex. The bottom 54 of the valve 50 has at least one leg 56. One end of the leg is secured to the bottom 54 of the valve component 50. The opposite free end extends downwardly and axially from the bottom of the disc-shaped valve 50. The leg 56 has a hook 58 at its free unattached end. The leg 56 is clearly illustrated in FIG. 13. The hook can also be described as a nub with a ledge. The hook is a means to retain the valve in the cylinder body while the water is flowing and draining from the present invention. In a preferred embodiment, three identical legs are positioned around the bottom periphery of the valve, and are separated by 60 degrees. The hook 58 catches on a concentric interior lip on the cylinder body.

Figure 10:
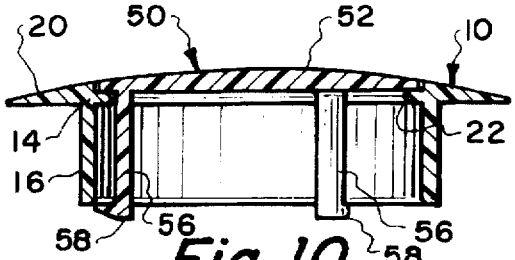
FIG. 10 is a vertical medial sectional view of the present invention as shown in FIG. 6.

The separate cylinder body 10 has an axially aligned cylinder portion, which further has a top 14, a side wall 16, and a bottom 18. The top 14 of the cylinder body has a wide concentric exterior flange 20. The top also has a narrow concentric interior flange or lip 22. The narrow flange is positioned slightly below the top surface of the cylinder body to create a seat for the valve. The seat is recessed. The seat is clearly shown in FIG. 1 and FIG. 10. The thickness of the valve 50 at its periphery is the same as the recess depth of the seat so that the valve when it is seated in the cylinder body forms a flush surface with the concentric flange 20. The valve 50 is installed into the cylinder body 10 by flexing the three legs 56 sufficiently inwardly to allow the hooks 58 to pass by and through the concentric lip 22. The legs then flex back to their axial position. The hooks 58 have sufficient clearance with the interior wall of the cylinder portion 12 to allow the valve to move up and down in the cylinder portion. Gravity will keep the valve closed. The force of the water discharging through the cylinder portion will force the valve upwardly until the hooks 58 stop the valve at it maximum open position. The water freely discharges past the open valve and is evenly dispersed to the adjacent grass area.

Figure 15:
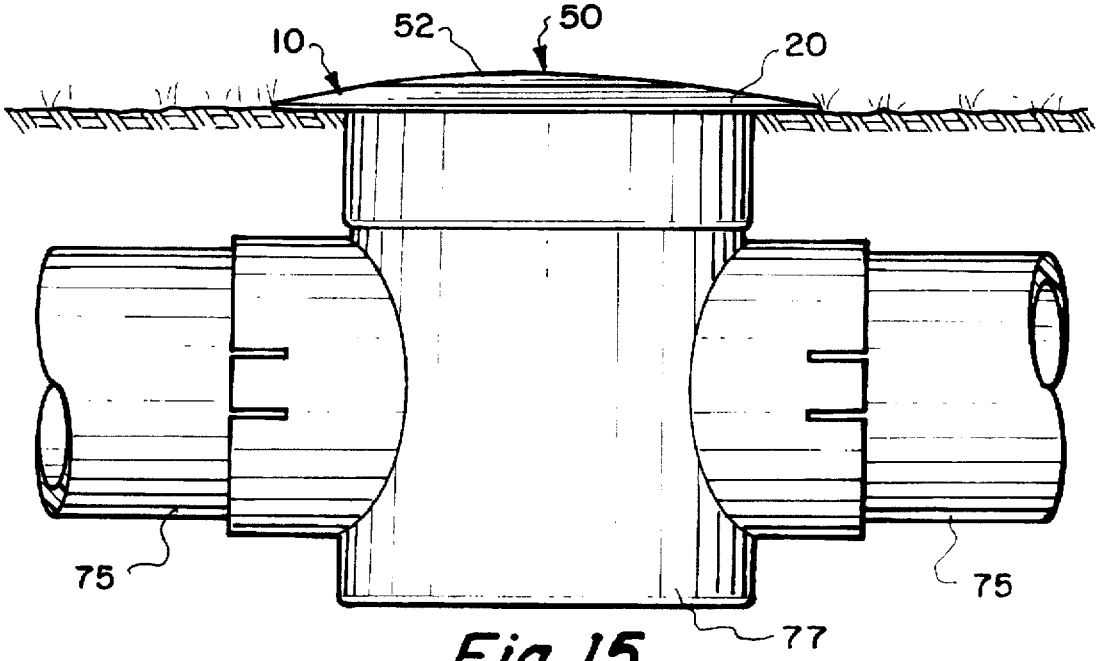
FIG. 15 is an elevational view of the present invention with the cylinder wall of the cylinder-shaped component inserted into an upright pipe connection, which is connected to a drainage system.

FIG. 15 illustrates the present invention properly positioned in the ground. Plastic pipe sections 75 are connected to a T joint 77. The top of the T joint is slightly below the surface. The cylinder body portion 10 has an outside diameter equal to the inside diameter of the mouth of the T joint. The present invention is pushed into the mouth until the concentric flange 20 touches the adjacent surface. This installation procedure can be modified to fit the particular soil area.

The top 52 of the valve and the concentric flange 20 create a slight mound appearance in the lawn so that it is easily visible to alert pedestrians not to step on it. The present invention, however is of sufficient strength to resist damage by foot traffic. The valve and the cylinder body are each injection molded using high density and strength polyethylene. The material used and the method of fabrication can vary. The flat dome low profile appearance allows a lawn mover to pass over it without being damaged. The valve seats securely in the cylinder body and forms a seal to prevent leaves, lawn clippings, or even small animals and insects from entering the drainage system and clogging it. The valve can also be described as a riser. The diameter of the valve is preferably four inches and the diameter of the concentric flange is preferably six inches.

Obviously, many modifications and variants of the present invention are possible in light of the above teachings. It is therefore to be understood that the full scope of the invention is not limited to the details disclosed herein, but may be practiced otherwise than as specifically described.

What is claimed is:

1. A water relief valve for a drainage system, which comprises:

a valve movably positioned in a separate cylinder body;

said valve comprising:

a disc having a concentric dome-shaped top surface;

at least one leg having one end secured to said valve and an opposite free end extending downwardly from said disc;

said leg having a stop means at said free end for preventing said valve from disengaging with said cylinder body whenever water is flowing through said cylinder portion and said valve;

said separate cylinder body comprising:

a cylinder portion having a side wall and an open bottom;

said top of said cylinder body having a concentric exterior flange;

said concentric exterior flange of said cylinder body having an outwardly and downwardly sloping top surface;

said cylinder body having a concentric interior lip recessed below said top of said cylinder body for receiving said valve and;

said concentric dome-shaped top surface of said valve and said concentric exterior flange of said cylinder body forming a concentric dome-shaped flush surface when in the closed position.

2. The water relief valve as recited in claim 1 where said valve and said cylinder portion are comprised of a molded plastic material.

3. The water relief valve as recited in claim 1 where said separate cylinder body is about six inches in diameter.

4. A water relief valve, which comprises:

a movable poppet valve positioned in a separate cylinder body;

said poppet valve comprising:

a disc having a concentric dome-shaped top surface and a bottom;

at least one leg having one end secured peripherally to said bottom of said valve and an opposite free end extending downwardly from said bottom of said valve;

said leg having a hook at said free end;

said separate cylinder body comprising:

a cylinder portion having an open top, a side wall, and an open bottom;

said top of said cylinder body having a concentric exterior flange;

said concentric exterior flange of said cylinder body having an outwardly and downwardly sloping top surface;

said cylinder body having a concentric interior lip recessed below said top of said cylinder body for receiving said valve; and said concentric dome-shaped top surface of said valve and said concentric exterior flange of said cylinder body forming a concentric dome-shaped flush surface when in the closed position.

5. The water relief valve as recited in claim 4 where said valve and said cylinder portion are comprised of a molded plastic material.

6. The water relief valve as recited in claim 4 where said separate cylinder body is about six inches in diameter.

7. A water relief valve for a drainage system, which comprises:

a valve movably positioned in a separate cylinder body;

said valve comprising:

a disc having a concentric dome-shaped top surface;

sliding means having one end secured to said valve and an opposite free end extending downwardly from said disc;

said sliding means having a stop means for preventing said valve from disengaging with said cylinder body whenever water is flowing through said cylinder portion and said valve;

said separate cylinder body comprising:

a cylinder portion having a side wall and an open bottom;

said top of said cylinder body having a concentric exterior flange;

said concentric exterior flange of said cylinder body having an outwardly and downwardly sloping top surface;

said cylinder body having a concentric interior lip recessed below said top of said cylinder body for receiving said valve and;

said concentric dome-shaped top surface of said valve and said concentric exterior flange of said cylinder body forming a concentric dome-shaped flush surface when in the closed position.

* * * * *